United States Patent [19]

Thompson et al.

[11] Patent Number: 4,839,511

[45] Date of Patent: Jun. 13, 1989

[54] ENHANCED SENSITIVITY PHOTODETECTOR HAVING A MULTI-LAYERED, SANDWICH-TYPE CONSTRUCTION

[75] Inventors: James C. Thompson, Austin, Tex.; Uzi J. Even, Tel Aviv, Israel; Chi-Woo Kim, Austin, Tex.

[73] Assignee: Board of Regents, The U. of Texas System, Austin, Tex.

[21] Appl. No.: 149,707

[22] Filed: Jan. 29, 1988

[51] Int. Cl.[4] ..... H01J 40/14

[52] U.S. Cl. ..... 250/211 R; 313/542

[58] Field of Search ..... 250/211 R, 211 J; 313/346 R, 542, 543, 544; 357/4, 15, 30 C, 30 E, 30 R

[56] References Cited

U.S. PATENT DOCUMENTS

| | | | |
|---|---|---|---|
| 3,006,786 | 10/1961 | Sjoberg | 117/219 |
| 3,697,794 | 10/1972 | Stoudenheimer | 313/94 |
| 3,838,304 | 9/1974 | McDonie | 313/94 |
| 3,959,037 | 5/1976 | Gutierrez | 148/171 |
| 3,960,620 | 6/1976 | Ettenberg | 148/175 |
| 4,039,887 | 8/1977 | McDonie | 313/346 R |
| 4,160,185 | 7/1979 | Tomasetti | 313/94 |
| 4,197,142 | 4/1980 | Boulton et al. | 250/211 R |
| 4,569,891 | 2/1986 | Shimizu | 430/57 |
| 4,701,395 | 10/1987 | Wronski | 430/58 |
| 4,736,234 | 4/1988 | Boulitrop et al. | 250/211 R |

OTHER PUBLICATIONS

Even et al., Enhanced Near-Threshold Photoemission from Adsorbate-Covered Au and Ag Films, Surface Science Letters 165, pp. L35-40, 1986.

*Primary Examiner*—David C. Nelms

*Attorney, Agent, or Firm*—Kareem M. Irfan

[57] ABSTRACT

A photoconductive member is provided with increased sensitivity to radiation incident thereupon and with increased photo-yield in response thereto by means of a multi-layered, sandwich-type construction based upon the provision of successive layers of sensitizing material over corresponding successive layers of conducting material. The photoconductive member comprises at least two composite layers formed one above the other on an insulating substrate, each composite layer comprising a first layer of material capable of conducting charge and a second layer of material comprising polar molecules disposed upon the charge-conducting material layer in such a manner that successive layers of polar molecules are adsorbed and retained in an oriented fashion on successive layers of the charge-conducting material. In combination, the alternating layers of charge-conducting material and polar molecules increase photo-yield in response to a given quantum of incident radiation and also increase the range of wavelength of incident radiation to which the photoconductive member is responsive. The sandwich-type construction permits photoconductor sensitivity to be increased as a function of the number of layers of conducting material and polar molecules used to form the photoconductive surface. The multi-layered construction also exhibits reduced sensitivity to the degrading effects of impurities, is adapted to convenient fabrication, and exhibits extended lifetime.

34 Claims, 4 Drawing Sheets

ENHANCED SENSITIVITY PHOTODETECTOR HAVING A MULTI-LAYERED, SANDWICH-TYPE CONSTRUCTION

BACKGROUND OF THE INVENTION

1. Field of the Invention

This invention relates generally to photodetectors having surfaces sensitive to incident radiation. More particularly, this invention relates to photodetectors in which sensitivity of the photoconductive surface is increased by provision of a sensitizing surface layer.

2. Description of Related Art

The photoconductive effect, wherein incident radiation is absorbed by a material and free carriers generated when the incident photon energy raises surface electrons from one permissible energy level to another, is very commonly used in photodetectors sensitive to the intensity as well as wavelength of incident radiation. A variety of inorganic and organic photoconductive materials have been conventionally used in various applications depending upon their photoconductive characteristics. Commonly used photoconductive materials include inorganic materials such as Selenium, Cadmium Sulphide, Zinc Oxide and organic materials such as Trinitrofluorenone and selected members of the poly-N-vinyl group. The use of organic photoconductive materials has been restricted because of their slow response due to the inherently small electric charge carrier mobility. Although inorganic photoconductive materials exhibit higher mobility of the carriers for electric charge, it is practically difficult to control the sensitivity of such materials to the wavelength of incident radiation.

Several techniques have been used to extend and enhance the photoemission of a given material. These are based generally on charge transfer to the source electrode by means of a chemical bond, or the formation of a surface sensitizing layer which decreases the metal work function, or on enhancing the electromagnetic field of incident photons in the neighborhood of the conductive surface so that the increased photon-electron interaction produces a corresponding increase in photo-yield.

A popular and probably the most commonly used approach to increasing the photo-yield of a photoconductive material has been the application of a sensitizing surface layer, made of material such as cesium or sodium, on the conducting surface so that the interaction at the junction of the two layers lowers the photo-threshold. Cesium is most often used as material for the sensitizing layer and cesiated photocathodes, particularly those of the multi-alkali metal type, exhibit substantially higher response sensitivity than non-cesiated photocathodes. However, a number of disadvantages are inherent with the use of cesium for forming the sensitizing layer that make cesiated photocathodes inadequate for certain applications.

A major problem with cesium is its high reactivity to dust and impurities, as well as elements, such as oxygen and hydrogen, which commonly exist in the vacuum chamber environment where photocathodes are fabricated. This factor directly translates to a complicated fabrication process because of the need to maintain an impurity-free environment. In addition, the overall lifetime of the photodetecting surface is substantially reduced due to degradation of the photoconductive surface as a result of contact with dust, dirt, and other impurities. Further, there are theoretical and practical limits to the extent by which the sensitivity of a conducting material may be increased by the use of a cesiated sensitizing layer. Accordingly, there exists a need for a photoconductor displaying enhanced sensitivity and photo-yield in response to incident radiation, without being subject to the above disadvantages.

SUMMARY OF THE INVENTION

It is a primary object of this invention to provide a photoconductor which exhibits increased photo-yield in response to incident radiation and which is sensitive to radiation of an extended range of wavelength.

It is an important object of this invention to provide a photoconductive surface of the above type which is relatively insensitive to the presence of dust, dirt, and other impurities.

A further object of this invention is to provide a photoconductor of the above type which is easy to fabricate and has an extended lifetime.

Yet another object of this invention is to provide a photodetector having a construction which is easily adapted to realizing a controllable degree of photo-yield and photosensitivity.

These and other objects are accomplished, according to the system of this invention, by means of a photodetector having a multi-layered, sandwich-type construction based upon the provision of successive layers of a charge-conducting material, each layer being sensitized with a surface layer of polar molecules. The polar molecules are adsorbed on the surface of the charge-conducting material and enhance photo-yield by producing an oriented surface molecule layer and reducing the work function of the material.

According to a preferred embodiment, the photoconductive member comprises at least two composite layers formed one above the other on an insulating substrate, each composite layer comprising a first layer of charge-conducting material and a second layer of material comprising polar molecules disposed upon the charge-conducting material in such a manner that successive layers of polar molecules are adsorbed and retained in an oriented fashion on successive layers of the charge-conducting material. The sandwich-type construction using alternating layers of charge-conducting material and polar molecules permits quantum photo-yield and wavelength sensitivity to be increased as a function of the number of composite layers that form the conductive member. The use of molecular dipoles for forming the sensitizing layers permits the stacking of a plurality of composite layers without loss of stability and results in convenience of fabrication and extended lifetime due to reduced sensitivity to the degrading effects of impurities.

BRIEF DESCRIPTION OF THE DRAWINGS

Other objects, advantages and various novel aspects of this invention will become apparent from the following detailed description taken in conjunction with the accompanying drawings in which.

DETAILED DESCRIPTION OF THE PREFERRED EMBODIMENTS

Figure 1:
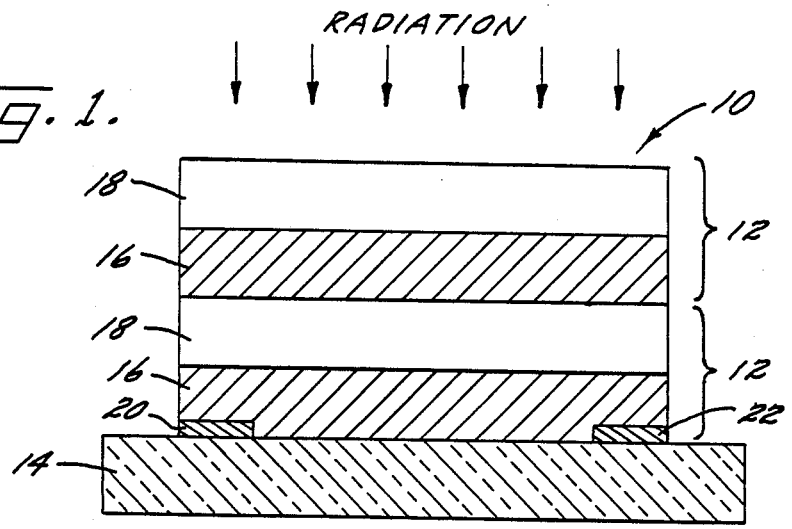
FIG. 1 is a sectional view of a photodetector based upon the multi-layered, sandwich-type construction according to this invention.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

Referring now to FIG. 1, there is shown a sectional view of a multi-layered, sandwich-type photoconductor according to the system of this invention. As shown therein, the photoconductor 10 essentially comprises a plurality of composite layers 12 successively formed on a supporting substrate 14. Each composite layer 12 comprises a layer of charge-conducting material 16 over which a sensitizing layer of molecules 18 is disposed. In essence, the successive molecular layers 18 are sandwiched between layers 16 of charge-conducting material, with the bottom-most layer of the photoconductor comprising charge-conducting material and the top-most layer being a layer of polar molecules. A pair of conducting contacts 20 and 22 are provided on the supporting substrate 14 in between the substrate and the first layer 16 of charge-conducting material formed thereupon. The end contacts 20 and 22 are preferably made of a conducting metal, such as chromium, and function as means through which a voltage potential may be applied across the layers of charge-conducting material for reasons to be described in detail below.

According to an important feature of this invention, the sensitizing layers 18 are formed of a material comprising polar molecules which are capable of being adsorbed upon the underlying conducting material in an oriented configuration. The interaction between the polar molecules and the conducting material produces an oriented dipole layer. This is clear from FIG. 2 which shows the manner in which individual molecules 18A of the dipole layer 18 become oriented in the same direction when they are adsorbed on the surface of an underlying layer 16 of charge-conducting material.

The presence of the oriented layer of dipoles on the conducting layer produces an electric field that changes the barrier for electron emission. More specifically, molecular adsorption on the surface of the charge-conducting layer causes the work function of the adsorbate and the charge-conducting surface to be reduced, thereby resulting in substantially increased quantum yield per adsorbed photon of incident radiation. The lowering of the work function is dependent upon the material of the conducting surface, the roughness of the surface, the kind of molecules adsorbed, and the coverage of the adsorbate.

Figure 2:
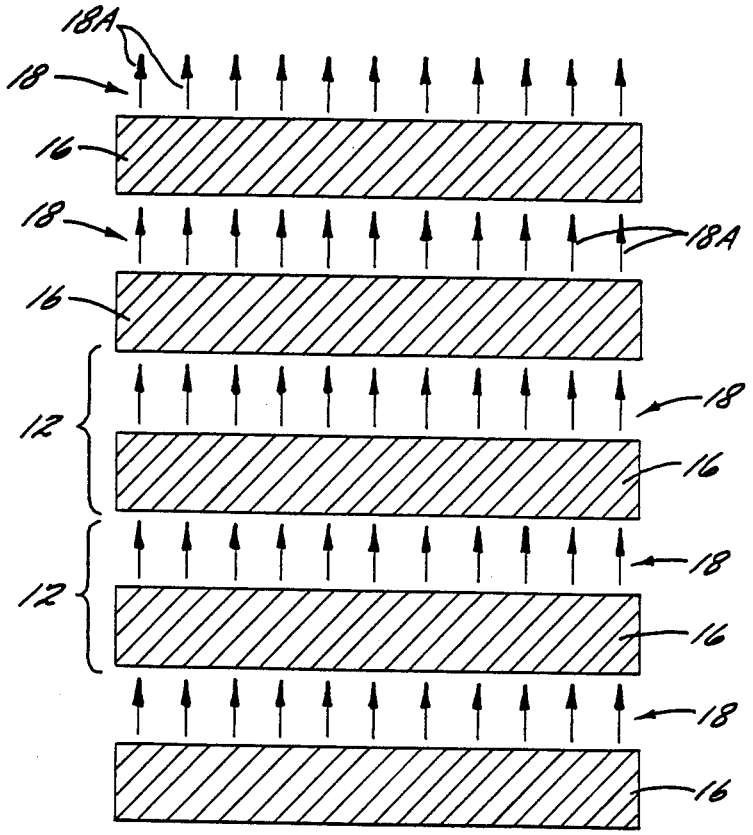
FIG. 2 is an enlarged fragmentary sectional view of the photoconductor of FIG. 1 showing the oriented nature of the sensitizing layers of molecular dipoles.

The orientation of the molecular dipoles on the charge-conducting surface determines whether the electron emission barrier is increased or reduced. If the molecules remain disoriented or oriented in a flat position, parallel to the underlying charge-conducting surface, there is no decrease in the surface potential at the charge-conducting surface. It is important that the charge-conducting material and the molecular dipoles used for sensitizing the material be selected in such a way that adsorption of molecules on the conducting surface causes the polar molecules to be oriented in an end-on position as shown in FIG. 2; in this orientation the dipole layer is effective in lowering the surface potential at the surface of the charge-conducting material.

It is an important feature of this invention that the charge-conducting material and the sensitizing polar molecules be selected so that the desired oriented nature of adsorbed molecules be retained even when successive composite layers are formed upon the substrate. According to a preferred embodiment, the layer 16 of charge-conducting material is formed of a metal selected from the group consisting of magnesium, zinc, copper and silver. The material for the layer 18 of polar molecules is selected from the group consisting of pyridine, ammonia and triethylammine. The metals listed above may be adequately sensitized with a layer of any one of the listed polar molecules to yield a substantial reduction in the work function by means of an interaction which causes the polar molecules to be oriented in an end-on position relative to the metal surface. More importantly, successive alternating layers of any such metal-polar molecules combinations can be formed without disrupting the desired orientation of the dipole layers. It is hence possible to greatly reduce the surface work function of the conducting surface and hence controllably increase its photo-yield and photosensitivity by using successive alternating layers of the listed metals and polar molecules, as shown in the sandwich-type construction of FIGS. 1 and 2.

Although the conventional use of sensitizing layers formed of cesium or sodium does bring about a reduction in surface work potential, the possibility of further increasing quantum yield is absent because cesiated layers do not lend themselves to a multi-layered construction. More specifically, cesium cannot be used for forming multiple sandwiched layers because of its interdiffusion characteristics relative to the conducting material between which a cesium layer is to be sandwiched. Further, the provision of additional cesiated layers has not been found to have any effect on increasing photosensitivity and can in fact degrade the photo-yield of the conductive surface.

It is significant that the multi-layered construction of this invention allows photo-yield and photosensitivity to be increased as a direct function of the number of composite layers that are used to form the photoconductive surface. In the preferred metal-dipole layer combinations, the polar molecules in each composite layer of metal and polar molecules retain their end-on orientation after interaction with the metal surface even when successive composite layers are formed on top of each other. However, it should be noted that the above-listed groups of preferred metals and polar molecules are for illustrative purposes only. Any combination of charge-conducting material and polar molecules may be used to form the multi-layered photoconductive surface provided that the polar molecules are capable of being adsorbed on the surface of the charge-conducting material to form a dipole layer having an end-on orientation (as shown in FIG. 2) and that the orientation is retained even when successive, alternating layers of the charge-conducting material and the polar molecules are formed.

Each layer of metal 16 forming the various composite layers is preferably formed to the minimum practical thickness possible with the fabrication procedure being used; this translates to a preferred metal thickness of about 10 Angstroms. The thickness of the dipole layer is preferably set to a single monolayer wherein the polar molecules are disposed on the underlying metal surface at the maximum level of density possible without adjacent molecules disorienting each other. However, submonolayers of polar molecules, wherein molecules are disposed on the underlying metal layers in a loosely spaced manner at a relatively lower level of density, may also be used.

The support substrate 14 of FIG. 1 is preferably formed of a substantially transparent and insulating material such as quartz or sapphire. It is also preferable that a layer of material presenting a relatively rough surface be deposited upon the insulating substrate 14 before the composite layers 12 are formed thereupon. In the preferred embodiment, a layer of calcium fluoride (not shown) is deposited onto the insulating substrate, preferably at a temperature of 77° K., so that a rough, granular surface is formed over which the bottom-most layer of metal is subsequently grown. The rough layer of calcium fluoride has been found to enhance the work function-lowering effect of the sensitizing layer of polar molecules.

Figure 3:
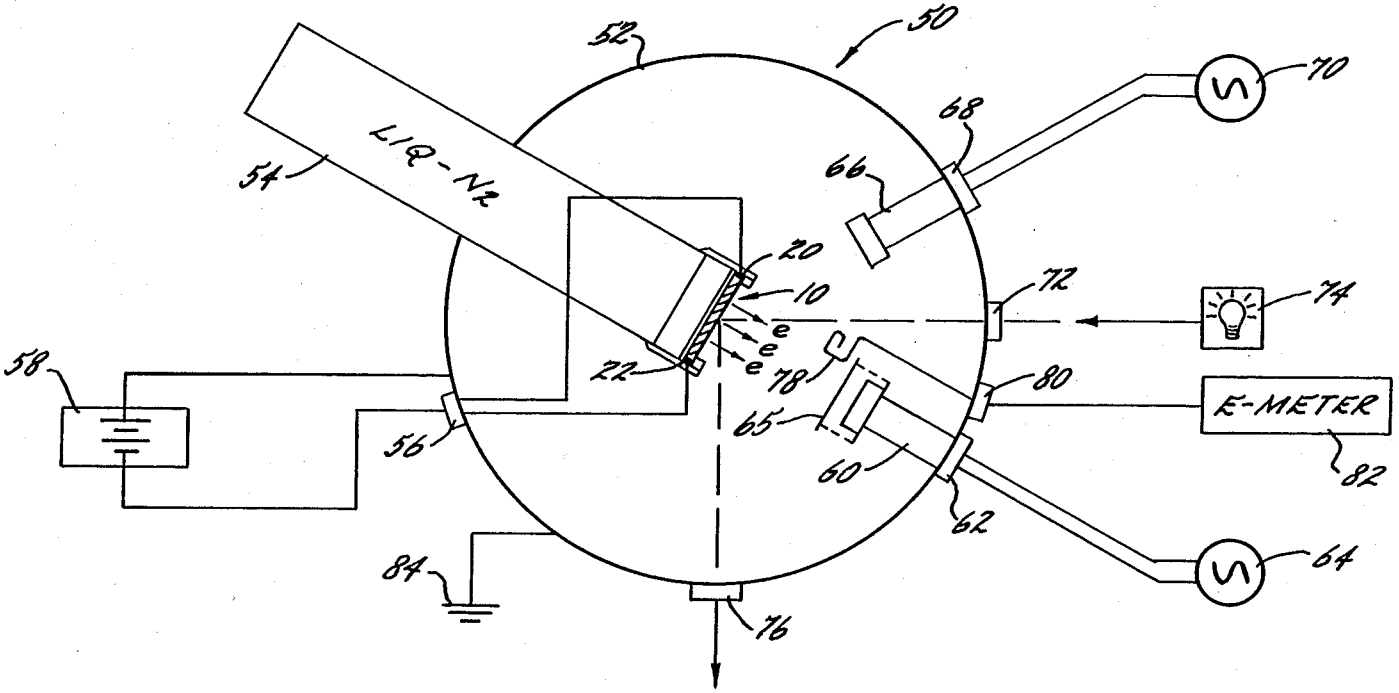
FIG. 3 is a schematic representation of a vacuum chamber arrangement for use in fabricating and operating the photoconductor of the present invention.

Turning now to FIG. 3 there is shown a schematic representation of the vacuum chamber arrangement used for fabrication and operation of the photoconductor according to this invention. As shown therein, the fabrication system 50 comprises a vacuum chamber 52 which is provided with support means 54 for holding the support substrate 14 of FIG. 1 in position for growth of the successive layers of metal and polar molecules thereupon. The support means 54 is in the form of a "cold finger" adapted to rigidly support the photoconductor member 10 and which includes means for maintaining the photoconductor member at the low temperatures (preferably in the liquid nitrogen temperature range and typically about 77° K.) necessary for optimum growth of the photoconductive surface layers.

The chromium end contacts 20 and 22 provided on the ends of the substrate 14 are linked through electrical feedthrough means 56 to a voltage source 64 located outside the vacuum chamber 52. The vacuum chamber 52 is provided with thermal evaporator means 60 which is linked through electrical feedthrough means 62 to an AC source 64. The evaporator means 60 functions to launch, through thermal evaporation, atoms of the desired metal contained within a heated boat (not shown) in the direction of the substrate 14 positioned on the cold finger 54. The evaporated atoms that strike the substrate 14 are adsorbed thereupon at the nitrogen temperature at which the cold finger 54 maintains the substrate. The thermal evaporator 60 is provided with shutter means 65 for selectively obstructing the flow of evaporated atoms and is of use in optimizing the thickness of deposited metal, by regulating the amount and period of exposure, and for maintenance purposes.

The vacuum chamber 52 is also provided with a second thermal evaporator means 66 which is linked through electrical feedthrough means 68 to an AC source 70. The evaporator 66 functions as a means for depositing, by thermal evaporation, layers of desired polar molecules stored within the evaporator onto metal layers previously deposited on the substrate 14. The evaporator 66 includes some form of valve means (not shown) for regulating the time and amount of exposure of evaporated polar molecules to the metal layers on the substrate 14.

A quartz window 72 is provided on the vacuum chamber 52 and serves as a means through which incident radiation may be focused on the photoconductive surface positioned by the cold finger 54. More specifically, the window 72 is positioned to permit light from a source of monochromatic radiation 74 to be incident upon the surface of the photoconductor 10. Light reflected from the photoconductive surface is directed out of the vacuum chamber 52 through a second quartz window 76 provided on the chamber. Measurement of photo-yield resulting from incident radiation is accomplished by means of a collector electrode 78 which is linked through electrical feedthrough means 80 to an electrometer 82. The vacuum chamber 52 is connected to a common ground point 84. Charge carriers i.e., electrons (see reference letters "e" in FIG. 2), generated from the photoconductive member as a result of the monochromatic light incident thereupon are attracted to and collected by the collector electrode 78 by virtue of a potential difference maintained therebetween. The resulting current is measured by the electrometer 82 and provides an indication of the photoyield.

It should be noted that the arrangement shown in FIG. 3 is aimed at maintaining ultra-high vacuum (UHV) conditions during the fabrication procedure and is preferable because such conditions permit the monitoring of impurity deposition as part of the evaporation process. The UHV conditions may be dispensed with if the presence of dust/impurities can be restricted. The non-reactive nature of the polar molecules used for the multiple sensitizing layers, according to the invention, allows fabrication and operation to proceed under impurity conditions which would be fatal for conventional cesiated photoconductive surfaces.

Figure 4:
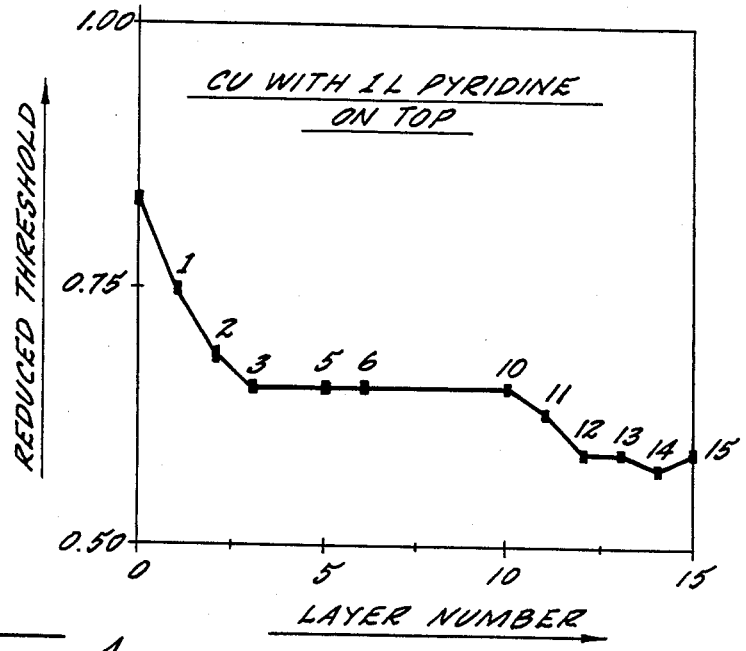
FIG. 4 is a graphical representation of the relationship between the number of composite layers forming the conductor and the corresponding reduction in photo-threshold.

Referring now to FIG. 4, there is shown a graphical representation of the reduction in photo-threshold that results with the use of added composite layers 14 (see FIG. 1) for forming the photoconductive surface. As used herein, the photo-threshold for a given photoconductive surface represents the minimum number of electrons emitted as a result of incident light (i.e., the minimum photoyield) that is required to generate a measurable current reading at the electrometer being used to monitor photoemission.

The Y-axis in FIG. 4 represents the reduction in the photo-threshold value resulting from use of a given number of composite layers comprising the metal-dipole layer combination as compared to the photo-threshold value obtained by using only the bare metal, without a sensitizing layer, as the photoconductive surface. The X-axis in FIG. 4 represents increasing number of composite layers, each composite layer being formed of a submonolayer of pyridine having a thickness of one Langmuir (L) disposed upon a layer of copper having an approximate thickness of 10 Angstroms. Since a monolayer of pyridine corresponds to a coverage of about 6—L, the thickness of pyridine used to obtain the curve of FIG. 4 corresponds to a submonolayer roughly one-sixth as thick as a single monolayer.

It is apparent from the curve shown in FIG. 4 that a substantial reduction in photo-threshold (extending from around 75% to about 54% of the original photo-threshold value) results as the number of composite layers is increased. It has been found experimentally that the reduction of photo-threshold tapers off at a point beyond the addition of about 14–15 composite layers so that further threshold reduction, if any, does not appear to be justified in view of the fabrication requirements involved in forming additional composite layers. It has been found that the enhanced photosensitivity achieved by the multi-layered construction is retained at room temperatures for periods up to 24 hours.

Figure 5:
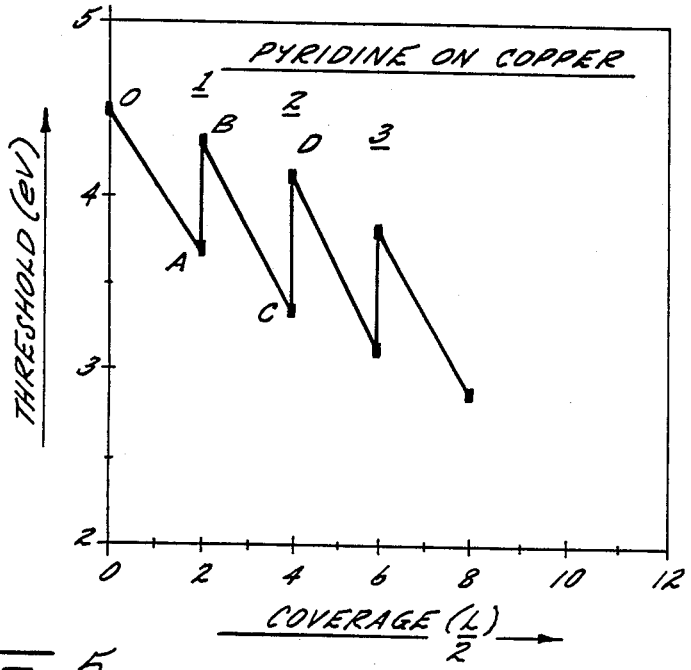
FIG. 5 is a graph illustrating the variation in photo-threshold as successive layers of charge-conducting material and polar molecules are formed upon the photoconductive surface.

Turning now to FIG. 5 there is illustrated a graphical representation of the variation in photo-threshold with the formation of successive alternating layers of metal and polar molecules. In particular, FIG. 5 represents the threshold variation as successive composite layers of pyridine having a thickness of 1—L are deposited on underlying layers of copper. As shown, the point 0 represents the bare metal threshold of about 4.5 eV resulting from the use of copper without any sensitizing layer. Point A represents the drop in threshold to a value of about 3.7 eV after a layer of pyridine has been formed on the base layer of copper. Point B illustrates the jump in threshold to a value of about 4.30 eV as the second layer of metal is formed upon the first layer of pyridine. The addition of the second layer of pyridine drops the threshold down to a value of about 3.3 eV (Point C). The point D represents the jump in threshold to a value of about 4.2 eV as the subsequent layer of copper is formed. This see-saw effect continues with the addition of subsequent alternating layers of copper and pyridine. It is obvious from the graph of FIG. 5 that the top-most layer forming the photoconductive surface, i.e., the surface layer upon which radiation is incident, should be formed of polar molecules in order to achieve maximum reduction in photo-threshold and the corresponding maximum increase in photo-yield.

Figure 6:
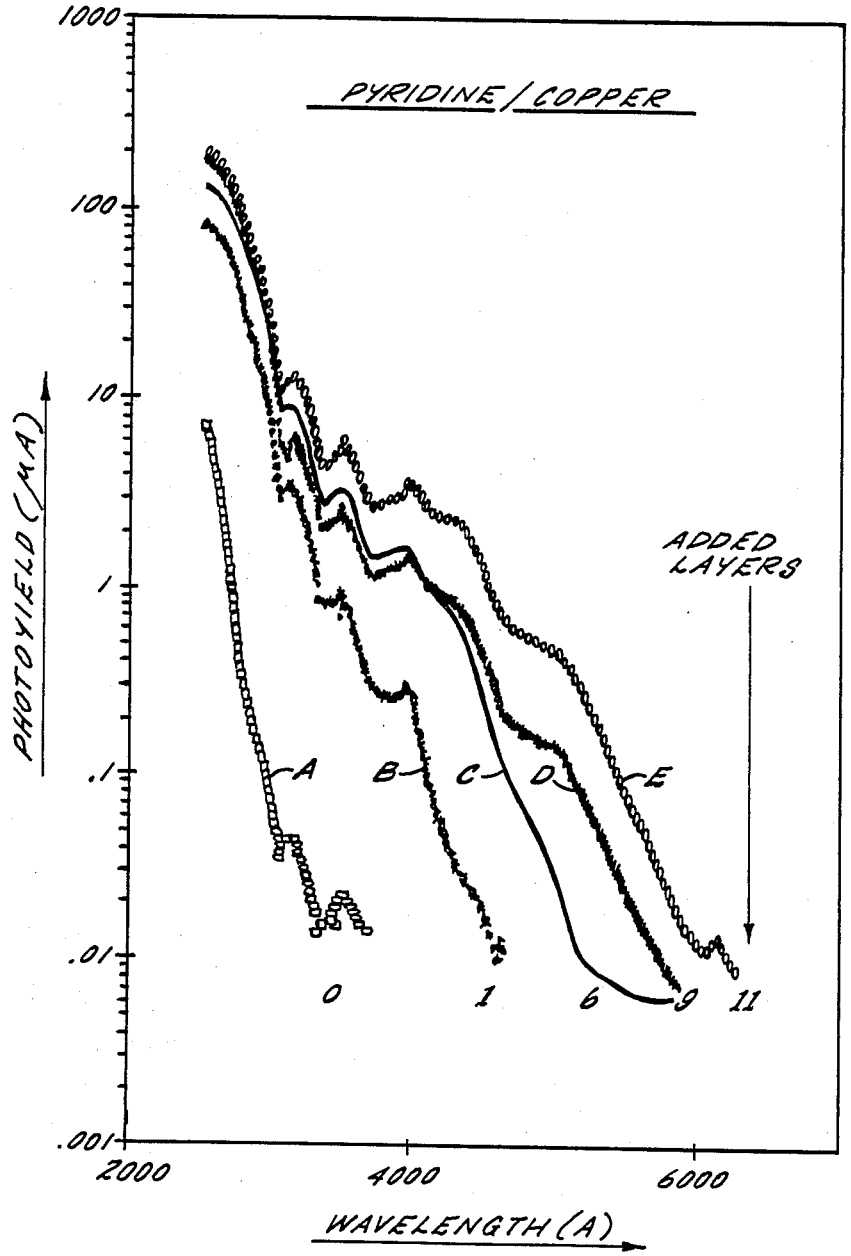
FIG. 6 is a graphical representation of the relationship between photo-yield and the wavelength of incident radiation as the number of composite layers is increased.

Referring to FIG. 6 there is shown a group of curves illustrating the increase, as a result of added composite layers, in the range of wavelength of incident radiation to which the photoconductor is responsive. The curves represent experimental results obtained with a multi-layered, sandwich-type photodetector using composite layers formed of copper and pyridine. Of the five curves represented by the reference letters A, B, C, D and E, curve A represents photo-yield vs. wavelength measurements on a photodetector using a copper layer without any sensitizing layer, while curves B, C, D, and E represent measurements on photodetectors respectively comprising 1, 6, 9, and 11 composite layers of copper and pyridine. The curves clearly show the increase in sensitivity to the wavelength of incident light from a cut-off wavelength of about 2900-A (measured at the 0.1 A point on the photoyield axis where measurements are substantially unaffected by noise) with the use of bare copper up to a maximum cut-off wavelength of 5500-A for a photoconductive surface using 11 composite layers. The curves in FIG. 6 also illustrate clearly the two-fold enhancing effect on photo-response resulting from the multi-layered construction of this invention: (i) increase in photoyield for a given quantum and wavelength of incident radiation; and (ii) increase in wavelength of incident radiation to which the photoconductive surface is responsive.

The following Table A provides a listing of experimental measurements comparing photo-threshold and photo-yield values for a conventional photodetector using a single monolayer of sodium formed on a layer of copper to a photodetector based upon the multi-layer construction of this invention and using four composite layers of polar molecules of pyridine or triethylammine on underlying layers of copper or magnesium.

TABLE A

| Metal | Layer | Relative Threshold | Normalized Yield |
|---|---|---|---|
| Copper | Sodium | 0.53 | 0.46 |
| Copper | Pyridine | 0.54 | 0.40 |
| Copper | Triethylammine | 0.66 | 0.75 |
| Magnesium | Sodium | 0.62 | 0.85 |
| Magnesium | Pyridine | 0.62 | 0.85 |
| Magnesium | Triethylammine | 0.55 | 1.80 |

Note that the values noted in the "Relative Threshold" column represent the measured photo-threshold as a fraction of the photo-threshold for the bare metal without any sensitizing layer. The values presented in the "Normalized Yield" column represent photo-yield measured at about 0.2 eV beyond the peak-yield point of the measured photo-response curves. As evident from Table A, the pyridine/copper composite structure provides about the same yield as conventional sodium/-copper structures while the triethylammine/copper structure exhibits relatively lower efficiency. When the base metal is magnesium, the triethylammine/magnesium structure provides more than twice the yield as the other structures.

Comparing the above results to the generally accepted relative threshold value of cesiated copper structures of 0.43, the multi-layered copper/pyridine structure provides a slightly higher relative threshold of about 0.54. However, unlike cesiated structures, there is the possibility of further reducing the relative threshold by the use of additional composite layers. More importantly, the multi-layered, sandwich-type construction allows the resulting photoconductor to be used efficiently in a wider number of applications in view of its ease of fabrication and reduced sensitivity to degradation because of the polar molecules being substantially less reactive than conventional sensitizing layers formed of cesium.

Although a planar geometry has been illustrated as the preferred embodiment (as shown in FIGS. 1 and 2), it will be obvious to those skilled in the art that the multi-layered, sandwich-type construction of this invention may also be realized with other suitable geometries. For instance, a co-axial geometry could be used wherein the substrate is in the form of a cylindrical core and the alternating layers of metal and polar molecules are formed as co-axial cylindrical coverings surrounding the core.

From the foregoing, it is apparent that the enhanced sensitivity photoconductor of this invention is adapted to be used in a wide variety of applications, particularly those in which conventional cesiated photoconductors are impractical. Because of its low sensitivity to impurities, and especially the high photo-yield available with addition of composite layers, a sandwich-type photoconductive surface according to this invention is particularly adapted to be used as an efficient electron source responsive to incident radiation. For instance, when operated in conjunction with a high intensity laser beam, the enhanced photo-yield available with added composite layers would make the photoconductive surface a prolific source of electrons for use in applications like electron lithography and free-electron lasers.

What is claimed is:

1. A photoconductive member with increased sensitivity to incident radiation of a predefined range of wavelength and with increased photo-yield in response thereto, said member comprising:

at least two composite layers formed one above the other, each composite layer comprising (i) a first layer of material capable of conducting charge and (ii) a second layer of material comprising molecular dipoles disposed upon said first layer in such a manner that said molecular dipoles are adsorbed on the surface of said charge-conducting material in an oriented fashion, whereby the alternating layers of charge-conducting material and molecular dipoles in combination increase the photo-yield of the photoconductive member in response to a given quantum of incident radiation and extend the range of wavelength of incident radiation to which the photoconductive member is sensitive.

2. The photoconductive member as set forth in claim 1, wherein said first layer of material comprises a material selected from the group consisting of magnesium, zinc, copper and silver.

3. The photoconductive member of claim 1 wherein said second layer of material comprises a layer of molecular dipoles of a material selected from the group consisting of pyridine, ammonia and triethylammine.

4. The photoconductive member of claim 1 wherein the thickness of said first layer of charge-conducting material is about 10 Angstroms.

5. The photoconductive member of claim 1 wherein said second layer of material is a monolayer of polar molecules.

6. The photoconductive member of claim 1 wherein said second layer of material is a sub-monolayer of polar molecules.

7. The photoconductive member of claim 1 wherein said composite layers are disposed over an insulating substrate.

8. The photoconductive member of claim 7 wherein said insulating substrate is a layer of material selected from the group consisting of quartz and sapphire.

9. The photoconductive member of claim 7 wherein a layer of calcium fluoride is disposed between said insulating substrate and said composite layers formed thereupon.

10. The photoconductive member of claim 7 further including conducting contacts disposed on the ends of said photoconductive member.

11. The photoconductive member of claim 10 wherein said conducting contacts are formed of chromium.

12. A method of making a photoconductive member exhibiting increased photo-yield and sensitivity to incident radiation of a predefined range of wavelength, said method comprising forming, on an insulating substrate, at least two alternating layers each of (i) a material capable of conducting charge and (ii) a material comprising polar molecules, said alternating layers being formed in such a manner that successive layers of polar molecules are adsorbed and retained in an oriented fashion on successive layers of said charge-conducting material.

13. The method according to claim 12 wherein a layer of non-conducting material is formed on said insulating substrate prior to forming said alternating layers thereupon, said non-conducting layer forming an uneven surface on which said alternating layers are substantially formed.

14. The method according to claim 13 wherein said layer of non-conducting material comprises calcium fluoride.

15. The method according to claim 12 wherein said material capable of conducting charge is selected from the group consisting of magnesium, zinc, copper and silver.

16. The method according to claim 12 wherein said layer of polar molecules comprises molecules of a material selected from the group consisting of pyridine, ammonia. and triethylammine.

17. The method according to claim 12 wherein each of said successive layers of charge-conducting material is formed to a thickness of about 10 Angstroms.

18. The method according to claim 12 wherein said alternating layers of polar molecules are monolayers of said polar molecules.

19. The method according to claim 12 wherein said alternating layers of polar molecules are sub-monolayers.

20. The method according to claim 12 wherein said insulating substrate is formed of a material selected from the group consisting of quartz and sapphire.

21. The method according to claim 12 further including the forming of conducting contacts on the ends of said photoconductive member.

22. The method according to claim 21 wherein said end contacts are formed of chromium.

23. An efficient source member for generation of electrons by radiation incident thereupon, said source member comprising a plurality of alternating layers of a charge-conducting material and a sensitizing material comprising polar molecules, successive layers of said polar molecules being adsorbed and retained in an oriented fashion on successive layers of said charge-conducting material.

24. The electron source member as claimed in claim 23 wherein the charge-conducting material is selected from the group consisting of magnesium, zinc, copper and silver.

25. The electron source member of claim 23 wherein the layers of polar molecules comprise molecules of a material selected from the group consisting of pyridine, ammonia and triethylammine.

26. The electron source member of claim 25 wherein said alternating layers of polar molecules are monolayers.

27. The electron source member claim 25 wherein said alternating layers of polar molecules are sub-monolayers.

28. The electron source member of claim 25 wherein said alternating layers of charge-conducting material and polar molecules are formed over a substrate of insulating material.

29. The electron source member of claim 28 wherein said substrate is formed of a material selected from a group consisting of quartz and sapphire.

30. The electron source member of claim 28 wherein a layer of non-conducting material is disposed between said insulating substrate and said alternating layers formed thereupon.

31. The electron source member of claim 30 wherein said non-conducting material is calcium fluoride.

32. The electron source member of claim 23 wherein the member comprises up to 15 alternating layers each of said charge-conducting material and said sensitizing polar molecules.

33. The method of forming a photoconductive member according to claim 12 wherein up to 15 alternating layers each of said charge-conducting material and said polar molecules are formed on said insulating substrate.

34. The photoconductive member of claim 1 wherein the member comprises up to 15 composite layers.

* * * * *